US005171929A

United States Patent [19]

Usa

[11] Patent Number: 5,171,929

[45] Date of Patent: Dec. 15, 1992

[54] OPERATIONAL HISTORY CONTROL DEVICE FOR AN ELECTRONIC MUSICAL INSTRUMENT

[75] Inventor: Satoshi Usa, Hamamatsu, Japan

[73] Assignee: Yamaha Corporation, Hamamatsu, Japan

[21] Appl. No.: 531,037

[22] Filed: May 31, 1990

[30] Foreign Application Priority Data

Jun. 1, 1989 [JP] Japan ..... 1-139697

[51] Int. Cl.[5] ..... G10H 1/18; G10H 1/32

[52] U.S. Cl. ..... 84/615; 84/618; 84/656

[58] Field of Search ..... 84/615, 617, 618, 622, 84/653, 655, 656, 670, 477 A, 478

[56] References Cited

U.S. PATENT DOCUMENTS

| | | | |
|---|---|---|---|
| 4,519,044 | 5/1985 | Munetsugu | 364/709 |
| 4,633,752 | 1/1987 | Koike et al. | 84/670 |
| 4,757,737 | 7/1988 | Conti | 84/654 |
| 4,791,847 | 12/1988 | Nishimoto | 84/622 |
| 4,829,869 | 5/1989 | Katada et al. | 84/622 |
| 4,887,503 | 12/1989 | Suzuki | 84/613 |
| 4,966,052 | 10/1990 | Shiraki et al. | 84/715 |
| 5,001,959 | 3/1991 | Kimpana | 84/635 |

FOREIGN PATENT DOCUMENTS 58-1833 1/1958 Japan .

*Primary Examiner*—William M. Shoop, Jr.
*Assistant Examiner*—Brian Sircus
*Attorney, Agent, or Firm*—Graham & James

[57] ABSTRACT

The invention provides an electronic musical instrument having a plurality of musical control functions, each musical control function having corresponding musical control data, wherein musical control is effected by designating the musical control data of one or more desired musical control functions. The electronic musical instrument of the present invention includes an operational portion provided with designation switches and a write switch, whereby when operation of the designation switches or write switch is detected, a designation indication signals or write indication signal is generated, respectively. Additionally, the electronic musical instrument of the present invention includes an operational history memory wherein operational history data is stored indicating the use history of each of the above mentioned musical control data. Moreover, the electronic musical instrument of the present invention includes a control section wherein when one of the above-mentioned designation indication signals has been generated, based on the above-mentioned operational history data, among the above-mentioned musical control data, data corresponding to one musical control function selected, displayed and designated, and wherein when one of the above-mentioned write indication signal has been generated, the currently displayed and designated musical control data is regarded as having been used resulting in the above-mentioned operational history data being updated using the current musical control data.

12 Claims, 6 Drawing Sheets

| ia / ja | 1 | 2 | 3 | 4 |
|---|---|---|---|---|
| | STRINGS | BRASS | PERCUSSIVE | ORGAN |
| 1 | VIOLIN 1 | TRUMPET 1 | PIANO 1 | JAZZ ORGAN |
| 2 | VIOLIN 2 | TRUMPET 2 | PIANO 2 | THEATER ORGAN |
| 3 | VIOLA 1 | TROMBONE 1 | ELECTRIC PIANO | CHURCH ORGAN 1 |
| 4 | VIOLA 2 | TROMBONE 2 | HARPSICHORD | CHURCH ORGAN 2 |
| 5 | CELLO | ——— | GUITAR | ——— |
| 6 | STRINGS | ——— | ——— | ——— |

FIG. 3

| ib / jb | 1 | 2 | 3 | 4 | 5 |
|---|---|---|---|---|---|
| | JAZZ | ROCK | FOLK | WALTZ | LATIN |
| 1 | SWING 1 | ROCK AND ROLL | FOLK 1 | WALTZ 1 | TANGO |
| 2 | SWING 2 | HARD ROCK 1 | FOLK 2 | WALTZ 2 | SAMBA |
| 3 | BOSSANOVA 1 | HARD ROCK 2 | FOLK 3 | WALTZ 3 | BOLERO |
| 4 | BOSSANOVA 2 | LATIN ROCK | FOLK 4 | ——— | RHUMBA |
| 5 | JAZZ WALTZ | BLUES | ——— | ——— | BEGUINE |
| 6 | ——— | 8 BEAT | ——— | ——— | MAMBO |
| 7 | ——— | 16 BEAT | ——— | ——— | CHACHA |
| 8 | ——— | ——— | ——— | ——— | HABANERA |

FIG. 4

OPERATIONAL HISTORY CONTROL DEVICE FOR AN ELECTRONIC MUSICAL INSTRUMENT

BACKGROUND OF THE INVENTION

1. Field of the Invention

The present invention relates to electronic musical instruments, and in particular, to operational factors for musical tone control operators for electronic musical instruments.

2. Prior Art

Electronic musical instruments are conventionally known for which the designation of tone generation control parameters is carried out by various timbre and rhythm designation switches, whereby when operation of these switches is detected, appropriate operational parameters are subsequently provided to the pertinent circuitry for each type of timbre and automatic rhythm function.

With another type of conventional electronic musical instrument, rather than an individual switch corresponding to each available timbre and rhythm control function, switches which control a number of timbre or rhythm control functions are provided along with a display panel for displaying the selected timbre or automatic rhythm pattern. With such a musical instrument a record is kept of the number of times an individual switch is pressed and a suitable timbre or rhythm control function is designated depending on the press count for a particular switch. Thus, the individual operating the electronic musical instrument can carry out designation of timbre or automatic rhythm functions by repeatedly pressing an appropriate designation switch while observing the display panel to verify that the desired function has been selected. As an example of this type of instrument in which one control switch activates a predetermined set of timbre or rhythm control functions based on the number of times the switch has been pressed, an implementation has been disclosed in Japanese Utility Model Publication No. SH058-1833.

With the first above described approach to timbre and rhythm control designation in which a separate corresponding switch is provided for each type of timbre and rhythm control function available, for an electronic musical instrument having a large number of available timbre and automatic rhythm functions, the large array of operational control switches necessitates a control panel with a considerably large switch mounting surface area. For the operator, such an arrangement presents the problem of searching for the switch which designates a desired function among a large array of operational control switches, thus leading to operating characteristics for the musical instrument which are less than optimal. With the type of instrument in which one control switch activates a predetermined set of timbre or rhythm control functions depending on the number of times the switch has been pressed, the ordering of available functions often bears no relation to the frequency at which a given individual selects particular timbre or automatic rhythm functions. Thus for an instrument having a large number of available timbre and rhythm control functions, if frequently used functions are at the end of a long menu of which each individual entry is displayed on the display panel one by one, and through which the operator must navigate the entire length by pushing the designation switch one time for each earlier entry, it often becomes necessary to press a particular switch some large number of times in order to select a desired function, thus requiring significant time. This is particularly troublesome when the operator wishes to select or change a function in the midst of a performance.

SUMMARY OF THE INVENTION

In consideration of the above, it is an object of the present invention to provide an electronic musical instrument for which selection of timbre and rhythm control functions can easily be carried out by a performer, and for which the necessary control panel surface area can be reasonably small, even when the instrument has a large number of available timbre and rhythm control functions.

As a means to this end, the present invention provides an electronic musical instrument having a plurality of musical control functions, each musical control function having corresponding musical control data, wherein musical control is effected by designating the musical control data of one or more desired musical control functions. The electronic musical instrument of the present invention includes an operational means provided with designation switches and a write switch, whereby when operation of the designation switches or write switch is detected, a designation indication signal or write indication signal is generated, respectively. Additionally, the electronic musical instrument of the present invention includes an operational history memory means wherein operational history data is stored indicating the use history of each of the above mentioned musical control data. Moreover, the electronic musical instrument of the present invention includes a control means wherein when one of the above mentioned designation indication signals has been generated, based on the above mentioned operational history data, among the above mentioned musical control data, data corresponding to one musical control function is selected, displayed and designated, and wherein when one of the above mentioned write indication signal has been generated, the currently displayed and designated musical control data is regarded as having been used resulting in the above mentioned operational history data being updated using the current musical control data.

With an electronic musical instrument provided with the above described operational means, operational history memory means and control means, through operation of a designation switch, based on the operational history data stored in the operational history memory means, among the above mentioned musical control data, data corresponding to one musical control function is selected and displayed. Through operation of the write switch, based on the currently designated musical control data, the operational history data is updated. In this way, based on the operational history data for the musical control data corresponding to each musical control function, display and designation of musical control data is carried out, thus making it possible for the individual operating the electronic musical instrument to rapidly designate a desired musical control function, and furthermore making it possible to limit the required switch mounting surface area.

BRIEF DESCRIPTION OF THE DRAWINGS

FIG. 3 is an explanatory diagram for showing the relationship between timbres and timbre groups in the electronic musical instrument shown in FIG. 1.

FIG. 4 is an explanatory diagram for showing the relationship between rhythm types and rhythm groups in the electronic musical instrument shown in FIG. 1.

DETAILED DESCRIPTION OF THE PREFERRED EMBODIMENTS

Figure 1:
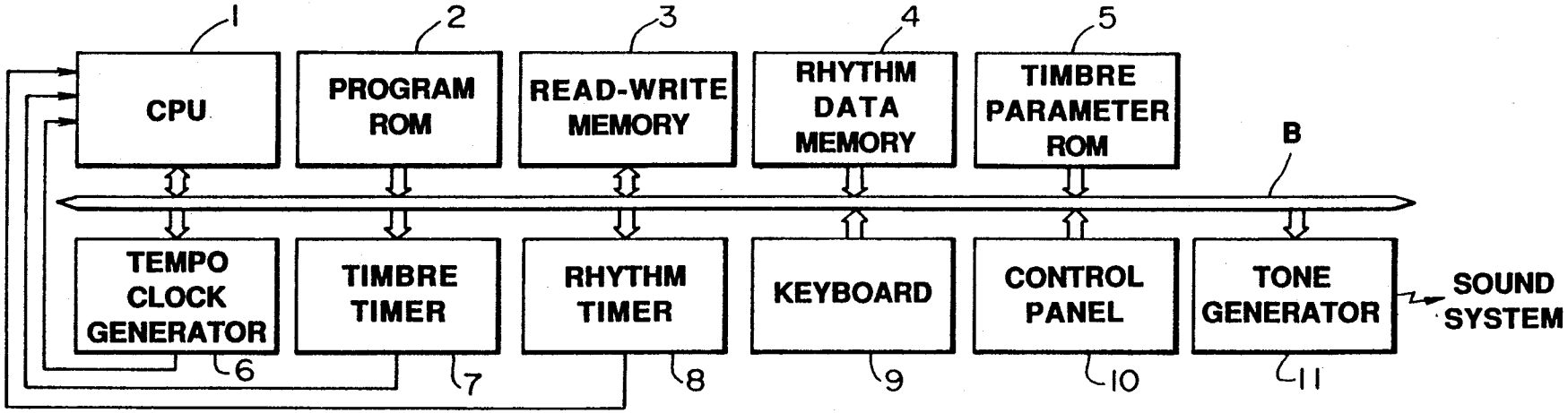
FIG. 1 is a block diagram showing the layout of an electronic musical instrument of a first preferred embodiment of the present invention.

In FIG. 1, a block diagram showing the functional layout of an electronic musical instrument of a first preferred embodiment of the present invention is presented. Shown in the diagram is a CPU (central processor unit) 1, wherein the overall operation of the electronic musical instrument is controlled. A control program for the control of operation of the electronic musical instrument is stored in program ROM (read only memory) 2. Read-write memory 3 is made up of volatile memory, for example RAM (random access memory), and non-volatile memory, for example magnetic media. The various rhythm patterns available in the electronic musical instrument of the present embodiment are stored in rhythm data ROM 4. The data for rhythm patterns consist of, for example, data expressing a cycle corresponding to the duration of a musical measure which is partitioned into a number of intervals of fixed duration, each partition containing data representing a rhythm tone generation on/off event, whereby data is provided representing a time ordered sequential rhythm pattern. Timbre parameter ROM 5 holds parameters representing envelope wave forms, modulation rate data, and other data representing timbre parameters corresponding to each timbre available in the electronic musical instrument. Tempo clock generator 6 is comprised of, for example, a crystal oscillator and a frequency divider, and provides clock pulses used for control of rhythm tone generation. While CPU 1 keeps a count of each clock pulse from the above mentioned tempo clock generator 6, a judgement is made with each clock pulse as to whether the count corresponds with any one of the bits in the rhythm pattern data for the rhythm pattern currently in effect, whereby based on corresponding values, on/off control of rhythm tone generation is controlled. Each of timbre timer 7 and rhythm timer 8 clock a respective designated clock interval, whereby interrupt signals are provided to CPU 1, on which basis timbre selection processing and rhythm selection processing are carried out, as will be described later. A keyboard 9 is provided whereby musical input can be effected. Control panel 10 includes an array of switches as well as a display unit. Tone generator 11 forms musical tones based on supplied parameters, after which the musical tones thus generated are then supplied to a sound system. All of the above described components are connected in common via a bus B. In electronic musical instrument of the present embodiment, the above mentioned program ROM 2, rhythm data ROM 4 and timbre parameter ROM 5 consist of executable code and data stored in conventional read only memory. It is also possible, however, to employ devices based on non-volatile read-write media, for example a magnetic disk drive. Additionally, volatile memory means such as RAM (random access memory) can be used to which the executable code and data has been uploaded from a primary memory means, for example ROM, a magnetic disk, an IC (integrated circuit) card, or the like.

Figure 2:
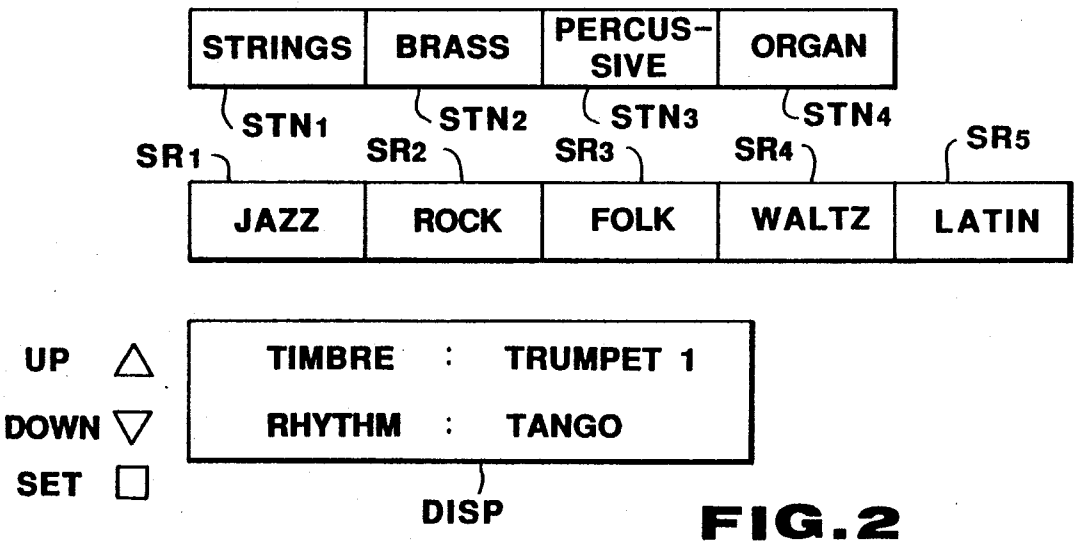
FIG. 2 shows various types of function switches provided on a portion of the control panel employed in the electronic musical instrument shown in FIG. 1.

In FIG. 2, a portion of the control panel 10 employed in the electronic musical instrument of the present embodiment is shown. In the drawing, timbre group switches $STN_1$ through $STN_4$ are shown which correspond, respectively, to a "STRINGS" timbre group, a "BRASS" timbre group, a "PERCUSSIVE" timbre group, and an "ORGAN" timbre group. Also shown are rhythm switches $SR_1$ through $SR_5$ which correspond, respectively, to a "JAZZ" rhythm group, a "ROCK" rhythm group, a "FOLK" rhythm group, a "WALTZ" rhythm group, and a "LATIN" rhythm group. More detailed descriptions of each timbre group and rhythm group will be provided later on. In FIG. 2, a liquid crystal dot matrix display DISP is seen, whereon the names of the various timbres and rhythm types can be displayed. UP and DOWN are directional switches through the use of which it is possible to navigate up and down through the various timbre and rhythm menus, thereby selecting the timbre and rhythm to be designated. The switch labeled SET is equivalent to the write switch described in the summary of the invention, by use of which, the operator can designate the timbre and/or rhythm currently displayed on the display panel DISP.

In FIGS. 3 and 4, charts are presented showing each of the timbres and automatic rhythm types, respectively, available in the electronic musical instrument of the present embodiment. As can be seen in FIGS. 3 and 4, each timbre is allocated to one of four timbre groups and each rhythm type is allocated to five rhythm groups, where each timbre group is indicated by both a timbre group number ia and a timbre group name, and each rhythm group is indicated by both a rhythm group number ib and a rhythm group name. Furthermore, within each timbre group, each timbre is assigned a timbre number ja, and within each rhythm group, each rhythm type is assigned a rhythm number jb. Timbre numbers and rhythm numbers will be described in further detail later. When the individual operating the electronic musical instrument presses one of the timbre group switches $STN_1$ through $STN_4$, the timbre group containing a desired timbre can be selected. Similarly, when the individual operating the electronic musical instrument presses one of the rhythm switches $SR_1$ through $SR_5$, the rhythm group containing a desired rhythm type can be selected.

In the following, the various data areas within read-write memory 3 will be described.

Timbre Group Data Area TGRP: The timbre group data area TGRP temporarily stores the number of a selected timbre group.

Rhythm Group Data Area RGRP: The rhythm group data area RGRP temporarily stores the number of a selected rhythm group.

Timbre Count Data Area TNCNT (i,j): In the timbre count data area TNCNT, the number of times each timbre group has been designated is stored. Thus, the timbre count data area TNCNT is subdivided into a number of entries, where entry (i,j) contains a value representing the number of times $j^{th}$ timbre within the $i^{th}$ timbre group has been designated.

Timbre Number Data Area LSTTN (i): The timbre number data area LSTTN contains the timbre number for the timbre most recently designated for each timbre group. Thus, for each timbre group i, the timbre number of the timbre last designated for that timbre group is stored.

Rhythm Count Data Area RHYCNT (i,j): In the rhythm count data area RHYCNT, the number of times each rhythm group has been designated is stored. Thus, the rhythm count data area TNCNT is subdivided into a number of entries, where entry (i,j) contains a value representing the number of times $j^{th}$ rhythm within the $i^{th}$ rhythm group has been designated.

Rhythm Number Data Area LSTRHY (i): The rhythm number data area LSTRHY contains the rhythm number for the rhythm most recently designated for each rhythm group. Thus, for each rhythm group i, the rhythm number of the rhythm last designated for that rhythm group is stored.

Mode Flag MD: The mode flag MD holds a value of one when the electronic musical instrument is in a timbre designation mode and holds a value of two when the musical instrument is in a rhythm designation mode.

Rank Data Area RNK: In electronic musical instrument of the present embodiment, based on the content of the rank data area RNK, timbres and automatic rhythm types can be displayed in menus on the display panel ordered according to the frequency of designation for each timbre and automatic rhythm type up to the current point in time. Within the rank data area RNK, numerical values are stored indicating the order of frequency of use for the various timbres and automatic rhythm types. When, for example, a value of [3] is stored in the rank data area RNK, the timbre or automatic rhythm type ranking number three for the number of times designated thus far is displayed on the display panel DISP.

Timbre Designation Data Area TNNO: For a timbre which is to be designated among the timbres in the timbre group currently designated by the value held in the timbre group data area TGRP, the corresponding timbre number is stored in the timbre designation data area TNNO.

Rhythm Play Data Area RHYPLY: The rhythm play data area RHYPLY holds data representing the two digit rhythm number for the rhythm pattern currently designated.

Rhythm Designation Data Area RHYNO: Based on the value within the rhythm designation data area RHYNO, the ones place of the rhythm number stored in the rhythm play data area RHYPLY is decided.

In the following, the operation of the electronic musical instrument of the present embodiment will be explained with reference to the flow charts in FIGS. 5 through 12.

Figure 5:
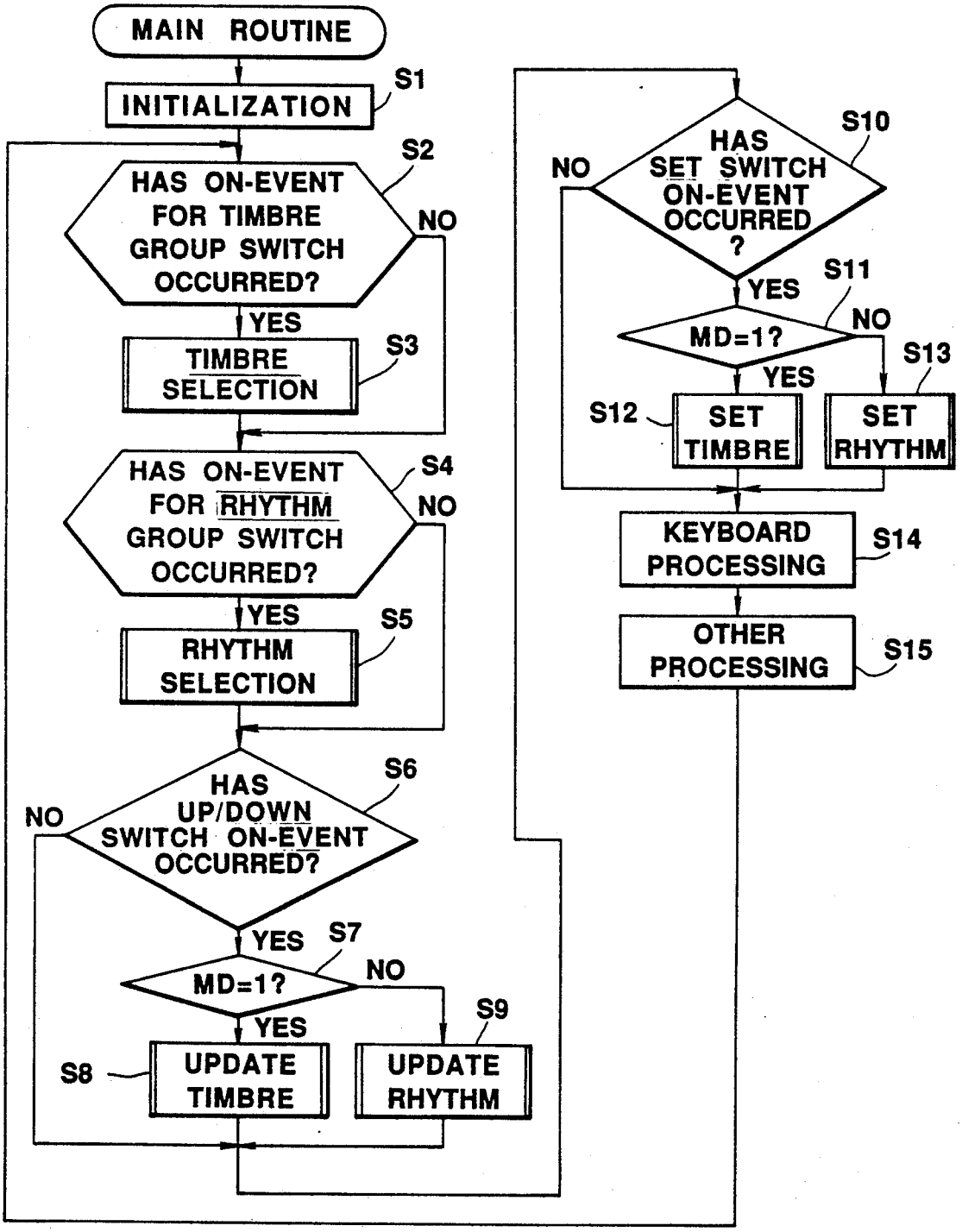
FIGS. 5 through 12 are flow charts showing program flow for the various routines included in a program as carried out by the CPU employed in the electronic musical instrument shown in FIG. 1.

After the power switch is turned on, thus supplying electrical power from the power supply to the other components in the electronic musical instrument of the present embodiment, CPU 1 proceeds to execute the main routine of a control program stored in program ROM 2 shown in the flow chart of FIG. 5. Thus, immediately after power is supplied, the above mentioned control program is read into CPU 1 from program ROM 2 via bus B, after which the execution of the main routine of the control program begins with step S1. In step S1, initial processing is carried out, wherein various data areas in read-write memory 3 are initialized. During the above mentioned initialization, the data areas corresponding to the timbre count data area TNCNT, rhythm count data area RHYCNT, timbre number data area LSTTN and rhythm number data area LSTRHY are not initialized, by rather are filled with the values held there during the last use of the electronic musical instrument from the non-volatile portion of read-write memory 3.

Figure 6:
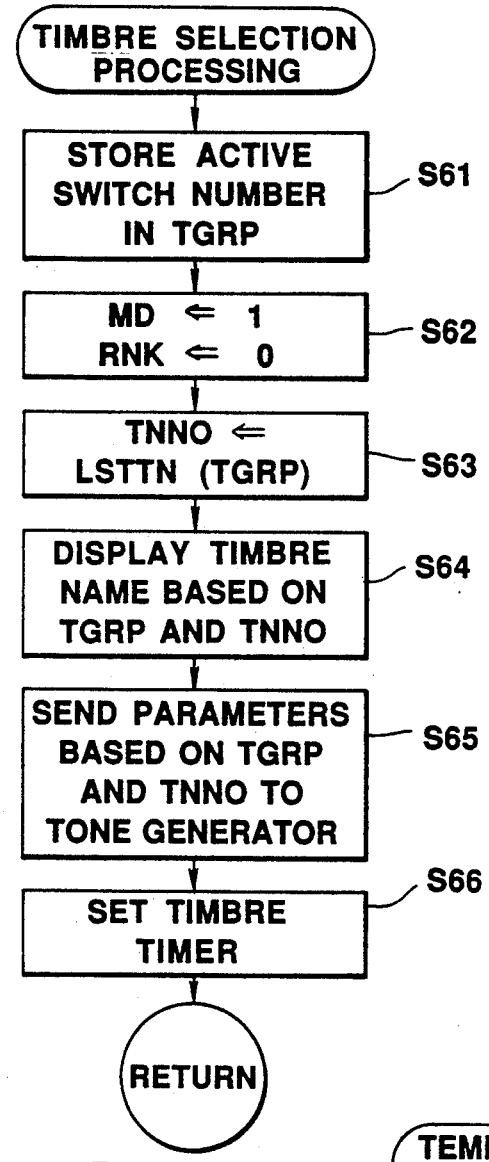
Figure 7:
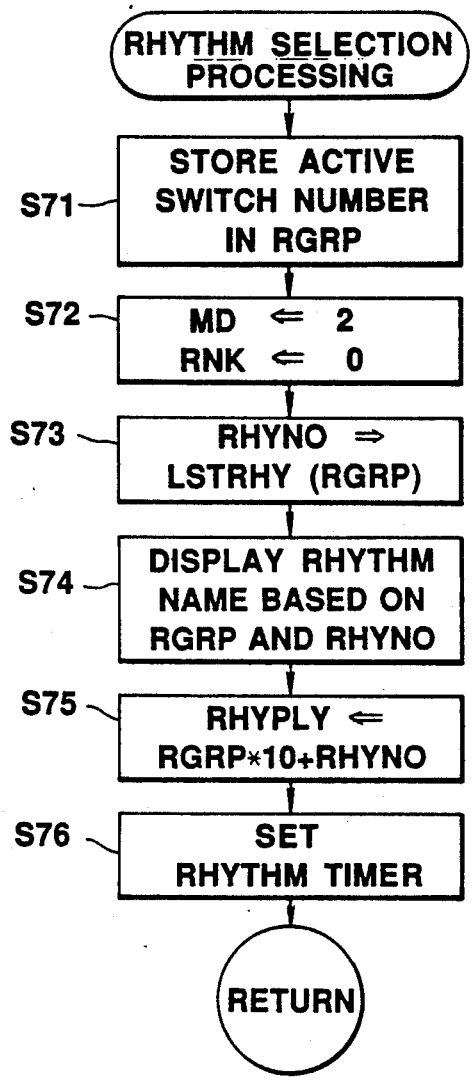

After completion of step S1, the routine proceeds to step S2 where a judgement is made as to whether any of the timbre group switches $STN_1$ through $STN_4$ have been pressed or not. When the result of this judgement is [YES], the routine proceeds to step S3, wherein the timbre selection routine shown in the flow chart of FIG. 6 is executed. After the timbre selection routine is completed, control returns to step S4 of the main routine shown in FIG. 5. When the result of the judgement in step S2 is [NO], the routine proceeds directly to step S4. In step S4, a judgement is made as to whether any of the rhythm group switches $SR_1$ through $SR_5$ have been pressed or not. When the result of this judgement is [YES], the routine proceeds to step S5, wherein the rhythm selection routine shown in the flow chart of FIG. 7 is executed. After the rhythm selection routine is completed, control returns to step S6 of the main routine shown in FIG. 5. When the result of the judgement in step S4 is [NO], the routine proceeds directly to step S6.

Figure 8:
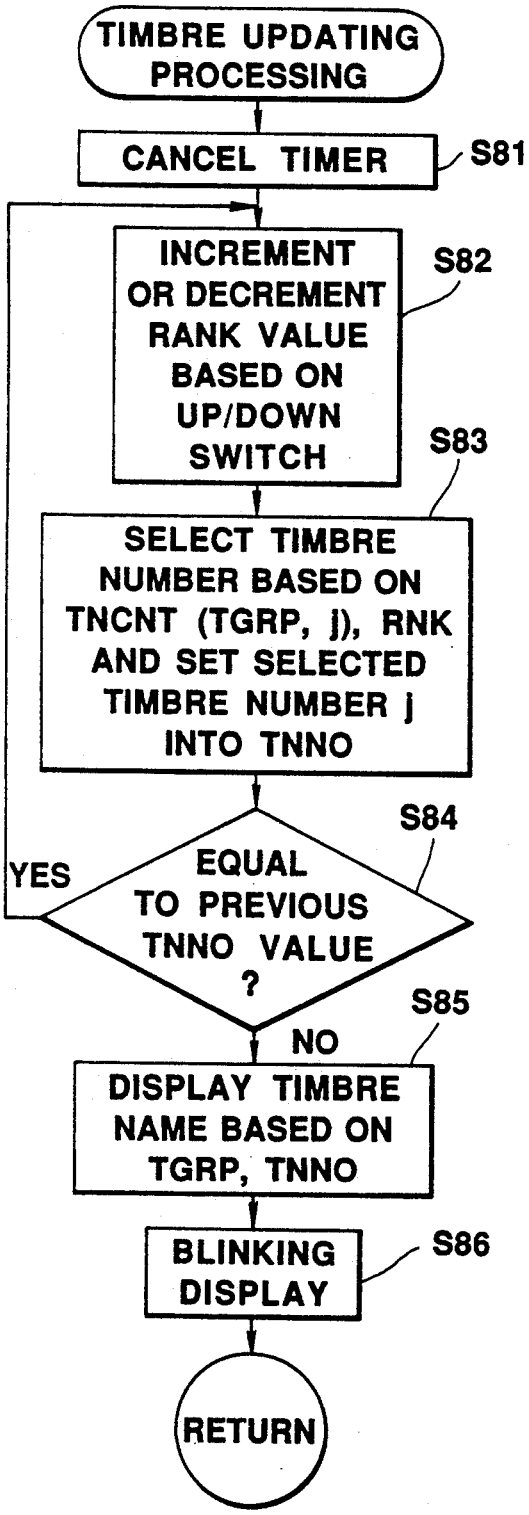
Figure 9:
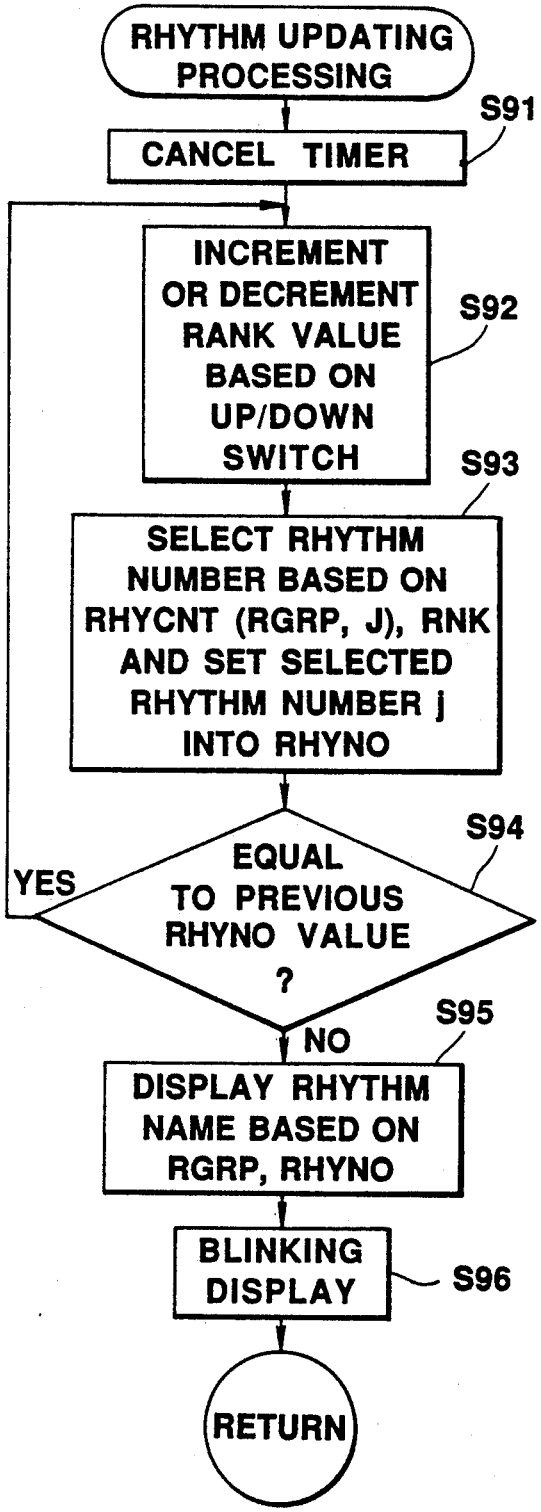

In step S6, a judgement is made as to whether or not an on-event for either the UP switch or the DOWN switch has been sensed. When the result of this judgement is [YES], the routine proceeds to step S7, whereas when the result of the judgement is [NO], the routine proceeds to step S10. When the result of the judgement is [YES] and the routine has proceeded to step S7, in step S7 a judgement is made as to whether the mode flag MD holds a value of [1] or not. When the result of the judgement in step S7 is [YES], the routine proceeds to step S8, and when the result of the judgement is [NO], the routine proceeds to step S9. When the routine has proceeded to step S8, therein the timbre updating routine shown in the flow chart of FIG. 8 is executed, after which control returns to step S10 of the main routine. On the other hand, when the routine has proceeded to step S9, therein the rhythm updating routine shown in the flow chart of FIG. 9 is executed, after which control returns to step S10 of the main routine.

Figure 10:
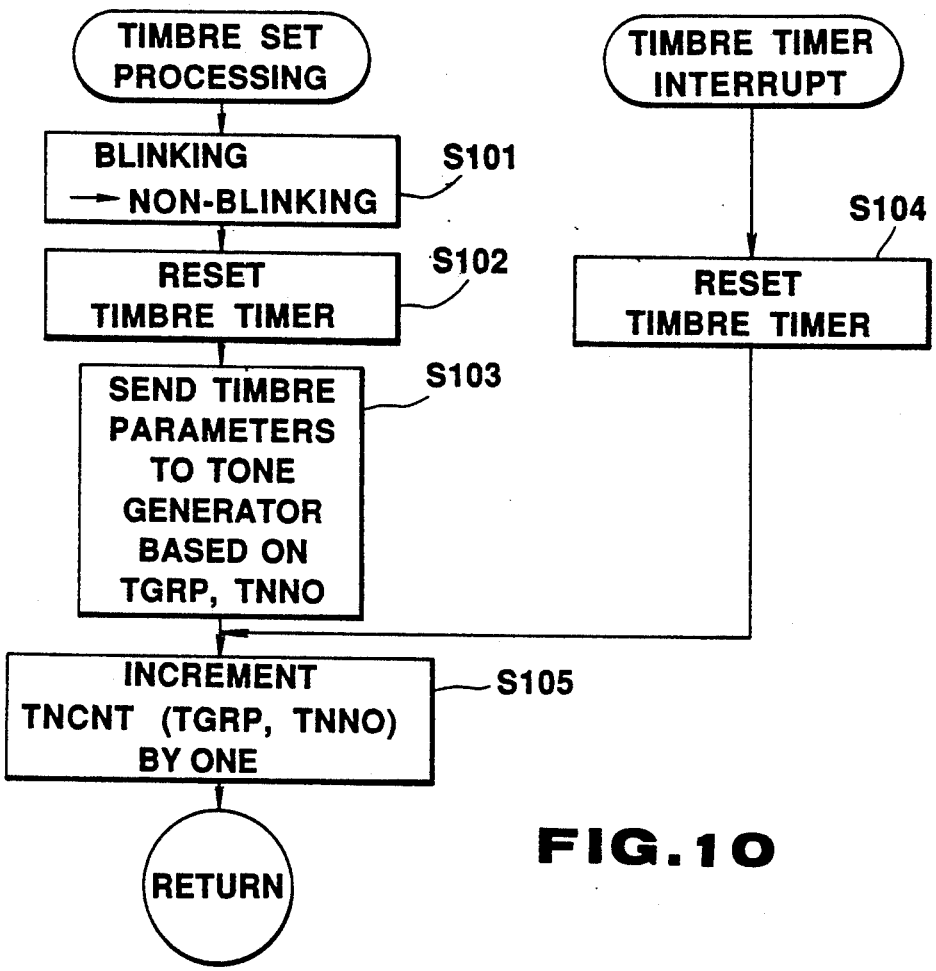
Figure 11:
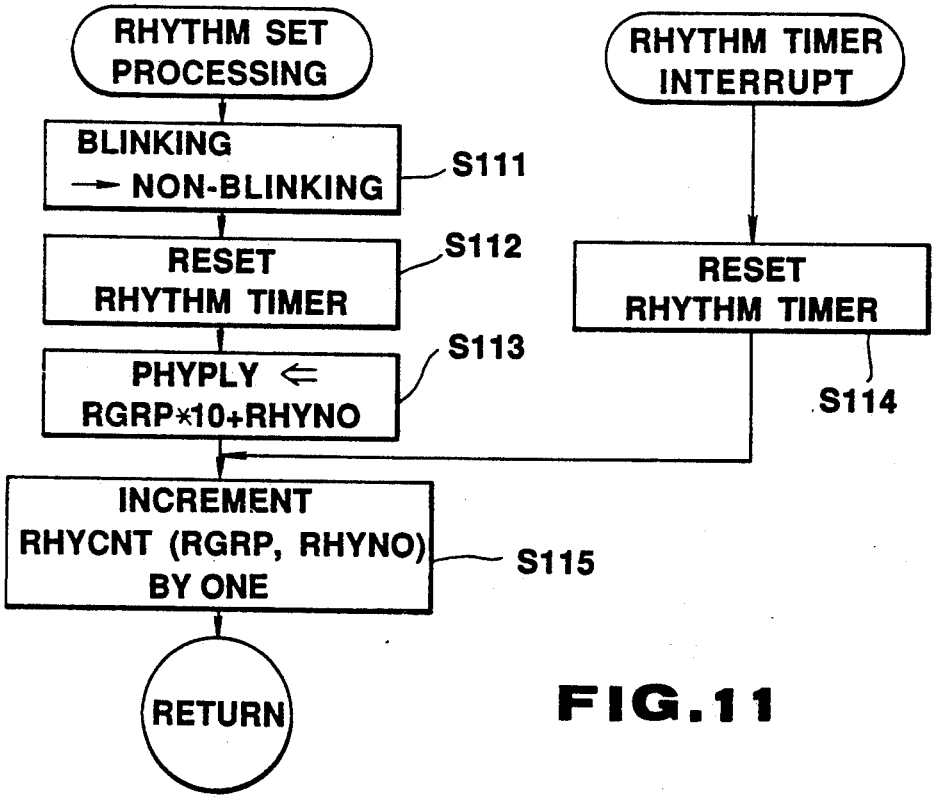

In step S10, a judgement is made as to whether an on-event for the write switch SET has been sensed. When the result of this judgement is [YES], the routine proceeds to step S11, whereas when the result of the judgement is [NO], the routine proceeds to step S14. When the result of the judgement is [YES] and the routine has proceeded to step S11, in step S11 a judgement is made as to whether the mode flag MD holds a value of [1] or not. When the result of the judgement in step S11 is [YES], the routine proceeds to step S12, and when the result of the judgement is [NO], the routine proceeds to step S13. When the routine has proceeded to step S12, therein the timbre set processing routine shown in the flow chart of FIG. 10 is executed, after which control returns to step S14 of the main routine. On the other hand, when the routine has proceeded to step S13, therein the rhythm set processing routine shown in the flow chart of FIG. 11 is executed, after which control returns to step S14 of the main routine. In step S14, keyboard key press processing is carried out, wherein key-on events and key-off events for keyboard 9 are detected, whereby when a key-on or key-off event is detected, a corresponding key-on signal or key-off signal is supplied from CPU 1 via bus B to tone generator 11, thereby initiating or terminating the generation of the corresponding tone. Next in step S15, other necessary processing is carried out, for example volume control processing, after which the routine returns to step S2.

Figure 12:
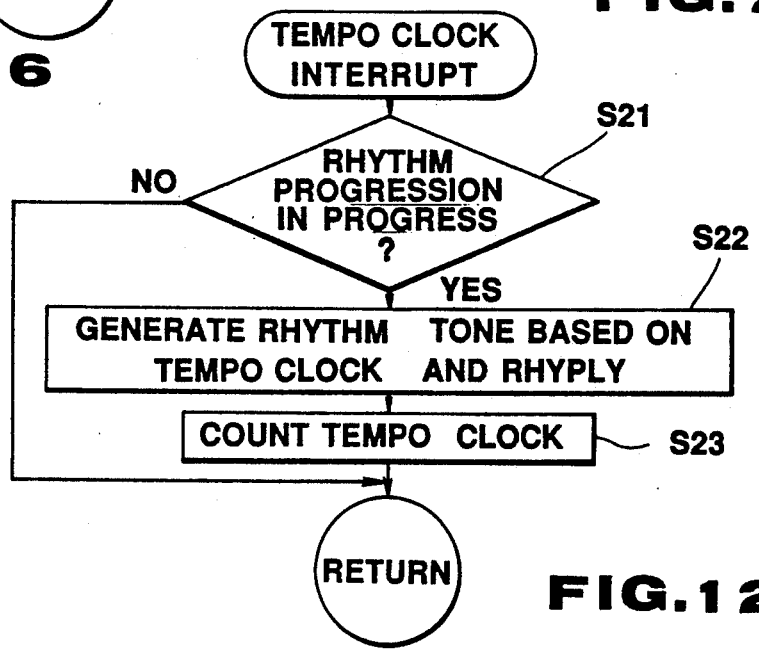

While CPU 1 repeatedly executes the above described main routine, tempo clock generator 6 simultaneously provides clock pulses to CPU 1 at a fixed frequency. Each time CPU 1 receives a tempo clock pulse, the routine being executed at that time is temporarily halted, and the tempo clock interrupt routine shown in the flow chart of FIG. 12 is executed, after which control returns to the halted routine.

When a tempo clock interrupt has been issued, the tempo clock interrupt routine begins with step S21 in which a judgement is made as to whether an automatic rhythm function is currently in effect or not. When the result of this judgement is [NO], the tempo clock interrupt routine terminates, after which control returns to the halted routine. On the other hand, when the result of this judgement is [YES], the tempo clock interrupt routine proceeds to step S22. In step S22, among the rhythm patterns stored in rhythm data ROM 4, the rhythm pattern indexed by the rhythm number currently stored in the rhythm play data area RHYPLY is referred to, and a determination is made as to which if any of the bits that are set in the indexed rhythm pattern correspond to the current tempo clock count. For any bits that are set, appropriate rhythm tone parameters are sent to tone generator 11, whereby any rhythm tones designated by the current rhythm pattern for the current tempo clock count.are generated. Then, in step S23, the tempo clock count is incremented by one, after which the tempo clock interrupt routine terminates, and control returns to the halted routine.

Timbre Designation Processing

When the individual operating the electronic musical instrument has pressed, for example, timbre group switch $STN_3$, the "PERCUSSIVE" timbre group is designated. In the following discussion, it will be assumed that the timbre number for the timbre most recently designated for the "PERCUSSIVE" timbre group prior to the present designation of the "PERCUSSIVE" timbre group is [3] which corresponds to "Electric Piano". This value of [3] is stored in the timbre number data area LSTTN at the entry for timbre group number three, that is, LSTTN(3). Furthermore, it will be assumed that the usage history for each timbre within the "PERCUSSIVE" timbre group is as shown in Table 1 below.

TABLE 1

| Timbre Number | Timbre Name | Number of Times Designated | Designation Frequency Rank |
|---|---|---|---|
| 1 | Piano 1 | 0 | 5 |
| 2 | Piano 2 | 11 | 1 |
| 3 | Electric Piano | 3 | 3 |
| 4 | Harpsichord | 1 | 4 |
| 5 | Guitar | 6 | 2 |

In the present example, the result of the judgement for step S2 in the main routine shown in FIG. 5 is [YES], thus the main routine proceeds to step S3, wherein the timbre selection routine shown in the flow chart of FIG. 6 is executed. Starting with step S61 in the timbre selection routine, there the timbre group number corresponding to the timbre group switch for which an on-event has been detected, $STN_3$ in the present example, is stored in the timbre group data area TGRP. Next, in step S62, mode flag MD is set to [1] for the timbre designation mode and the rank data area RNK is set with an initial value of [0]. Then, in step S63, the value stored in timbre number data area LSTTN representing the timbre number of the most recently designated timbre in the currently designated timbre group LSTTN(TGRP), that is, LSTTN(3) in the present example, is written to the timbre designation data area TNNO. Next, in step S64, the timbre indicated by the timbre group number stored in the timbre group data area TGRP and the timbre number stored in the timbre designation data area TNNO is selected, "Electric Piano" (see FIG. 3) in the present example, and displayed on the display panel DISP. Next, in step S65, the timbre parameters for the timbre selected in step S64 are read out from timbre parameter ROM 5 and supplied to tone generator 11. In this way, the designated timbre is established in tone generator 11. Next, in step S66, the data corresponding to a fixed time interval is set in timbre timer 7 via bus B and a signal directing the initiation of timer operation is generated. In this way, a timing operation by timbre timer 7 is initiated. Then, the timbre selection routine terminates and control returns to the main routine. Then, since the operator has only pressed the timbre group switch $STN_3$ in the present example, the main routine proceeds from step S4 to step S6 to step S10 where the result of this judgement is [NO], and thus the routine proceeds to step S14, the step S15, after which it returns to step S2. Afterwards, the above described steps step S2 to step S15 are repeated.

In the electronic musical instrument of the present embodiment, when no on-event has been detected for any of the timbre group switches $STN_1$ through $STN_4$, the UP switch, or the DOWN switch, and the clocking of the time interval set in timbre timer 7 has completed, a timbre timer interrupt is sent to CPU 1. As a result, CPU 1 halts the routine currently under execution, and commences execution of the timbre set processing routine shown in the flow chart of FIG. 10 starting with step S104. In step S104, a signal directing the termination of timer operation for timbre timer 7 is generated, after which the routine proceeds to step S105. In step S105, the entry in the timbre count data area TNCNT corresponding to the timbre currently indicated by the timbre group number stored in the timbre group data area TGRP and the timbre number stored in the timbre designation data area TNNO, TNCNT(TGRP, TNNO) is incremented by one, that is, in the present example, entry TNCNT(3, 3) in the timbre count data area TNCNT is incremented by one. As a result, the value for the entry in the timbre count data area TNCNT at TNCNT(3, 3) which corresponds to "Electric Piano" is incremented from [3] to [4]. In this way, by operation of a timbre group switch in the electronic musical instrument of the present embodiment, the timbre last selected for the designated timbre group becomes the currently designated timbre, after which if after a predetermined time interval has passed, no switch concerned with timbre designation has been operated, the currently designated timbre is considered to be the desired timbre selected by the operator of the electronic musical instrument.

On the other hand, if for example, an on-event has been detected for the DOWN switch before the clocking of the time interval set in timbre timer 7 has completed, a judgement of [YES] will be made in step S6 of the main routine, whereby the routine proceeds to step S7 wherein a judgement is made as to whether the mode flag MD holds a value of [1] or not. Since the timbre group switch $STN_3$ has already been pressed in the present example, the mode flag MD has been set to [1] (in step S62 in the timbre selection routine shown in FIG. 6), the result of this judgement is [YES] and the routine proceeds to step S8. In step S8, the timbre updating routine shown in the flow chart of FIG. 8 is initiated.

Starting with step S81 of the timbre updating routine, first of all, a signal directing the termination of timer operation for timbre timer 7 is generated, after which the routine proceeds to step S82. In step S82, if the timbre designation switch for which an on-event has been detected is the UP switch, the value held in the rank data area RNK is decremented by one (the designation frequency rank is upgraded by one). On the other hand, if the timbre designation switch for which an on-event has been detected is the DOWN switch, the value held in the rank data area RNK is incremented by one (the designation frequency rank is downgraded by one). In the present example, the value held in the rank data area RNK will be incremented by one, thus the initial value in the rank data area RNK of [0] will be updated to a value of [1]. Next, in step S83, the entry in the timbre count data area TNCNT (i, j) for which the timbre group number i corresponds to the timbre currently indicated by the timbre group number stored in the timbre group data area TGRP and for which the ranking of the value of the entry is equal to the value currently stored in the rank data area RNK is determined, and the timbre number which corresponds to that entry is stored in the timbre designation data area TNNO. Thus, for the present example entry TNCNT(TGRP, j), that is entry TNCNT(3, j) for which the ranking of the value stored therein equals 1 (current value of rank data area RNK) is determined, and the corresponding timbre number j for that entry, which is [2] in the present example, is stored in the timbre designation data area TNNO. Next, in step S84, a judgement is made as to whether the newly registered value in the timbre designation data area TNNO has been previously stored there or not, up to the current point in time. When the result of this judgement is [YES], the routine returns to step S82 and the rank data area RNK is once again incremented. In this way, it is insured that the no timbre name continuously appears more than once in a timbre menu shown on the display panel DISP. In the present example, the value previously stored in the timbre designation data area TNNO was [3]. Accordingly, the result of the judgement in step S84 is [NO] and the routine proceeds to step S85.

In step S85, the timbre indicated by the timbre group number stored in the timbre group data area TGRP ([3]) and the timbre number stored in the timbre designation data area TNNO ([2]) is selected, "Piano 2" in the present example, and displayed on the display panel DISP. Next, in step S86, the timbre name displayed on the display panel DISP is caused to flash, thereby indicating that timbre updating processing is in progress. The timbre updating routine then terminates and control returns to step S10 in the main routine.

Afterwards, if the individual operating the musical instrument presses the DOWN switch, when the main routine next repeats and proceeds up to step S8. In step S8, the timbre updating routine shown in the flow chart of FIG. 8 is executed, wherein the value held in the rank data area RNK is incremented, after which, timbre name corresponding to the updated value in the rank data area RNK is displayed on the display panel DISP.

When, for example, the individual operating the musical instrument desires to designate "Harpsichord", but has mistakenly pushed the DOWN switch one too many times, thus sequentially displaying "Piano 2" → "Guitar" → "Electric Piano" →"Harpsichord" → "Piano 1", by pushing the UP switch one time, "Harpsichord" is again displayed and can thereby be designated. In this case, when the main routine again repeats and proceeds up to step S8 where the timbre updating routine is executed, therein after executing step S81, in step S82 of the timbre updating routine, the value held in the rank data area RNK is decremented since the UP switch has been pressed. As a result, the value held by the rank data area RNK is changed from [5] to [4]. Thus, after proceeding through steps S83 through S86, "Harpsichord" is displayed on the display panel DISP.

After the operator verifies that the desired timbre "Harpsichord" is displayed on the display panel DISP, by pushing the write switch SET, the result of the judgement in step S10 of the main routine is [YES], whereby the routine proceeds to step S11, wherein the result of the judgement as to whether the content of mode flag MD is [1] or not is [YES], whereby the main routine proceeds to step S12. When the routine has proceeded to step S12, therein execution of the timbre set processing routine shown in the flow chart of FIG. 10 is initiated, starting with step S101. In step S101, first of all, a control signal is sent to the display panel DISP, whereby the currently flashing timbre name displayed there is caused to cease flashing, and thus is displayed to the operator by steady (non flashing) characters. Next, in step S102, a signal directing the termination of timer operation for timbre timer 7 is generated, after which the routine proceeds to step S103. In step S103, the timbre parameters for the "Harpsichord" timbre corresponding to the timbre group number stored in the timbre group data area TGRP ([3]) and the timbre number stored in the timbre designation data area TNNO ([4]) are read out from timbre parameter ROM 5 and supplied to tone generator 11 via bus B. In this way, the designated timbre "Harpsichord" is established in tone generator 11. Next, in step S105, the entry in the timbre count data area TNCNT corresponding "Harpsichord", TNCNT(3, 4) is incremented by one, after which the timbre set processing routing terminates.

When the operator presses timbre group $STN_3$ when the electronic musical instrument is in the state shown in the above Table 1, and wishes to try a timbre setting which he/she does not customarily use, by pressing the UP switch, those timbres least often selected appear on the display panel DISP. In this case, when the main routine repeats and passes through steps S6 through S8, on reaching step S8, the processing jumps to the timbre updating routine shown in FIG. 8. Here, after proceeding up to step S82, since the UP switch has been pressed, the value held in the rank data area RNK is decremented. Prior to decrementation, the value held in the rank data area RNK was [0] in the present example. When a decrementation is to occur when the value held in the rank data area RNK is [0], the result is that the rank data area RNK holds the lowest ranking rank value for the designated timbre group, which is [5] in the present example. Next, the routine proceeds executes steps S83 through S86, whereby the timbre name for the timbre having the lowest ranking designation frequency rank, that is "Piano 2" having a designation frequency rank of [5], is displayed on the display panel DISP. Then, if the operator desires the select the displayed timbre, that is "Piano 2", by pressing the write switch SET, "Piano 2" is designated.

Rhythm Designation Processing

When the individual operating the electronic musical instrument has pressed, for example, rhythm group switch $SR_1$, the "JAZZ" rhythm group is designated. In the following discussion, it will be assumed that the rhythm number for the rhythm most recently designated for the "JAZZ" timbre group prior to the present designation of the "JAZZ" timbre group is [1] which corresponds to "SWING 1". This value of [1] is stored in the rhythm number data area LSTRHY at the entry for rhythm group number one, that is, LSTRHY at the entry for rhythm group number one, that is, LSTRHY(1). Furthermore, it will be assumed that the usage history for each rhythm within the "JAZZ" rhythm group is as shown in Table 2 below.

TABLE 2

| Rhythm Number | Rhythm Name | Number of Times Designated | Designation Frequency Rank |
|---|---|---|---|
| 1 | Swing 1 | 9 | 1 |
| 2 | Swing 2 | 0 | 5 |
| 3 | Bossa Nova 1 | 6 | 2 |
| 4 | Bossa Nova 2 | 2 | 4 |
| 5 | Jazz Waltz | 3 | 3 |

In the present example, the result of the judgement for step S4 in the main routine shown in FIG. 5 is [YES], thus the main routine proceeds to step S5, wherein the rhythm selection routine shown in the flow chart of FIG. 7 is executed. Starting with step S71 in the rhythm selection routine, there the rhythm group number corresponding to the rhythm group switch for which an on-event has been detected, $SR_1$ in the present example, is stored in the rhythm group data area RGRP. Next, in step S72, mode flag MD is set to [2] for the rhythm designation mode and the rank data area RNK is set with an initial value of [0]. Then, in step S73, the value stored in rhythm number data area LSTRHY representing the rhythm number of the most recently designated rhythm in the currently designated rhythm group LSTRHY(RGRP), that is, LSTRHY(1) ([1]) in the present example, is written to the rhythm designation data area RHYNO. Next, in step S74, the rhythm indicated by the rhythm group number stored in the rhythm group data area RGRP ([1]) and the rhythm number stored in the rhythm designation data area RHYNO ([1]) is selected, "Swing 1" (see FIG. 4) in the present example, and displayed on the display panel DISP along with the rhythm number ([1]). Next, in step S75, a two digit rhythm number is calculated, taking the value stored in the rhythm group data area RGRP ([1]) for the tens place, and the value stored in the rhythm designation data area RHYNO ([1]) as the ones place, thus calculating the result [11] which is then stored in the rhythm play data area RHYPLY. As a result, when a tempo clock interrupt occurs, the rhythm pattern indexed by the rhythm number currently stored in the rhythm play data area RHYPLY is referred to, which is the rhythm progression used when the "JAZZ" rhythm group was last designated, and a determination is made as to which if any of the bits that are set in the indexed rhythm pattern "Swing 1" correspond to the current tempo clock count. For any bits that are set, appropriate rhythm tone parameters are sent to tone generator 11, whereby any rhythm tones designated by the current rhythm pattern for the current tempo clock count are generated.

Next, in step S76, the data corresponding to a fixed time interval is set in rhythm timer 8 via bus B and a signal directing the initiation of timer operation is generated. In this way, a timing operation by rhythm timer 8 is initiated. Then, the rhythm selection routine terminates and control returns to the main routine.

In the electronic musical instrument of the present embodiment, when no on-event has been detected for any of the rhythm group switches $SR_1$ through SR5, the UP switch, or the DOWN switch, and the clocking of the time interval set in rhythm timer 8 has completed, a rhythm timer interrupt is sent to CPU 1. As a result, CPU 1 halts the routine currently under execution, and commences execution of the rhythm set processing routine shown in the flow chart of FIG. 11 starting with step S114. In step S114, a signal directing the termination of timer operation for rhythm timer 8 is generated, after which the routine proceeds to step S115. In step S115, the entry in the rhythm count data area RHYCNT corresponding to the rhythm currently indicated by the rhythm group number stored in the rhythm group data area RGRP and the rhythm number stored in the rhythm designation data area RHYNO, RHYCNT(RGRP, RHYNO) is incremented by one, that is, in the present example, entry RHYCNT(1, 1) in the rhythm count data area RHYCNT is incremented by one.

On the other hand, if for example, an on-event has been detected for the DOWN switch before the clocking of the time interval set in rhythm timer 8 has completed, a judgement of [YES] will be made in step S6 of the main routine, whereby the routine proceeds to step S7 wherein the result of this judgement is [NO], after which the routine proceeds to step S9. In step S9, the rhythm updating routine shown in the flow chart of FIG. 9 is initiated.

Starting with step S91 of the rhythm updating routine, first of all, a signal directing the termination of timer operation for rhythm timer 8 is generated, after which the routine proceeds to step S92. In step S92, since the timbre designation switch for which an on-event has been detected is the DOWN switch, the value held in the rank data area RNK is incremented by one (the designation frequency rank is downgraded by one). In the present example, since the value held in the rank data area RNK will be incremented by one, the initial value in the rank data area RNK of [0] will be updated to a value of [1]. Next, in step S93, the entry in the rhythm count data area RHYCNT (i, j) for which the rhythm group number i corresponds to the rhythm currently indicated by the rhythm group number stored in the rhythm group data area RGRP and for which the ranking of the value of the entry is equal to the value currently stored in the rank data area RNK is determined, and the rhythm number which corresponds to that entry is stored in the rhythm designation data area RHYNO. Thus, for the present example entry RHYCNT(RGRP, j), that is entry RHYCNT(1, j) for which the ranking of the value stored therein equals 1 (current value of rank data area RNK) is determined, and the corresponding rhythm number j for that entry, which is [1] in the present example, is stored in the rhythm designation data area RHYNO. Next, in step S94, a judgement is made as to whether the newly registered value in the rhythm designation data area RHYNO has been previously stored there or not, up to the current point in time. In the present example, the result of this judgement is [YES], and the routine returns to step S92 where the rank data area RNK is once again incremented. After the content of the rank data area RNK is incremented from [1] to [2] , the routine proceeds to step S93 again. In step S93, the entry in the rhythm count data area RHYCNT(1, j) for which the ranking of the value of the entry is equal to the value currently stored in the rank data area RNK is determined, and the rhythm number which corresponds to that entry is stored in the rhythm designation data area RHYNO. Thus, for the present example entry RHYCNT(RGRP, j), that is entry RHYCNT(1, j) for which the ranking of the value stored therein equals 2 (current value of rank data area RNK) is determined, and the corresponding rhythm number j for that entry, which is [3] in the present example, is stored in the rhythm designation data area RHYNO. Next, in step S94, a judgement is made as to whether the newly registered value in the rhythm designation data area RHYNO has been previously stored there or not, up to the current point in time. In the present example, the result of this judgement is [NO], and the routine proceeds to step S95. In step S95, the rhythm indicated by the rhythm group number stored in the rhythm group data area RGRP ([1]) and the rhythm number stored in the rhythm designation data area RHYNO ([3]) is selected, "Bossa Nova 1" in the present example, and displayed on the display panel DISP. Next, in step S96, the rhythm name displayed on the display panel DISP is caused to flash, thereby indicating that rhythm updating processing is in progress. The rhythm updating routine then terminates and control returns to the main routine.

Afterwards, if the individual operating the musical instrument presses the DOWN switch, control passes to the rhythm updating routine shown in the flow chart of FIG. 9, wherein the value held in the rank data area RNK is incremented, after which, the rhythm name corresponding to the updated value in the rank data area RNK is displayed on the display panel DISP. If the individual operating the musical instrument then presses the UP switch, control again passes to the rhythm updating routine shown in the flow chart of FIG. 9, wherein this time the routine proceeds through step S91 and then proceeds to step S92. In step S92, since the UP switch was pressed, the value held in the rank data area RNK is decremented, after which, the rhythm name corresponding to the updated value in the rank data area RNK is displayed on the display panel DISP.

After the operator verifies that the desired rhythm "Bossa Nova 1" is displayed on the display panel DISP, by pushing the write switch SET, the result of the judgement in step S10 of the main routine is [YES], whereby the routine proceeds to step S11, wherein since the content of mode flag MD is [2], the result of the judgement as to whether the content of mode flag MD is [1] or not is [NO], whereby the main routine proceeds to step S13. When the routine has proceeded to step S13, therein execution of the rhythm set processing routine shown in the flow chart of FIG. 11 is initiated, starting with step S111.

In step S111, first of all, a control signal is sent to the display panel DISP, whereby the currently flashing rhythm name displayed there is caused to cease flashing, and thus is displayed to the operator by steady (non flashing) characters. Next, in step S112, a signal directing the termination of timer operation for rhythm timer 7 is generated, after which the routine proceeds to step S113. Next, in step S113, a two digit rhythm number is calculated, taking the value stored in the rhythm group data area RGRP for the tens place, and the value stored in the rhythm designation data area RHYNO as the ones place, and the result is then stored in the rhythm play data area RHYPLY. As a result, rhythm tones are generated in tone generator 11 based on the designated rhythm pattern. In step S115, the entry in the rhythm count data area RHYCNT corresponding to the rhythm currently indicated by the rhythm group number stored in the rhythm group data area RGRP and the rhythm number stored in the rhythm designation data area RHYNO, RHYCNT(RGRP, RHYNO) is incremented by one, after which the routine terminates execution.

As thus described, with the electronic musical instrument of the present embodiment, when the individual operating the musical instrument desires to select one of the available timbres or automatic rhythm patterns, choices are presented in menus on the display panel DISP ordered based on the frequency of designation in the past for each available timbre and automatic rhythm pattern. In this way, it becomes possible for the operator to rapidly and efficiently select timbres or rhythm patterns.

In the above described first preferred embodiment of the present invention, a suitable implementation of a timbre and rhythm designation means has been described. However, the present invention should not be considered to be so limited. For example, rather than, or in addition to timbre and rhythm designation, the designation means of the present invention could be suitably applied to effect designation, ABC (automatic accompaniment) pattern designation, as well as to designation of various other control modalities.

Furthermore, designation control was achieved based and rankings of frequency of use of the various available timbre and rhythm functions in the present embodiment. However, with the present invention, it is also acceptable to apply a last in—first out (LIFO) buffer to the designation means, so that when menus are displayed, the content of the buffer is successively read out, thus providing choices that reflect past use patterns, thereby enhancing speed and efficiency of timbre and rhythm selection.

Additionally, in the present embodiment, menus were navigated using an UP switch and a DOWN switch, however, it would also be acceptable to increment or decrement the menus by successively pressing an appropriate timbre or rhythm group designation switch.

Moreover, in the present preferred embodiment, for timbre or rhythm designation, first of all, an appropriate timbre or rhythm group was designated, after which the desired timbre or rhythm was selected from within the chosen group, however, the invention is not so limited. For example, when a close association between certain rhythms and timbres exist, after a rhythm is designated, a menu of timbres which are frequently associated with that rhythm pattern could then be displayed, again, with the order based on frequency of designation in the past. Thus, in this way, the operating ease of the electronic musical instrument could be yet further enhanced.

Which is to say, the above described first present preferred embodiment was presented as a concretely described example of the present invention, but is in no way to be construed as a limiting example. Thus, the present invention should be considered to include all embodiments encompassed by the appended claims.

What is claimed is:

1. An electronic musical instrument having a plurality of musical control functions for which musical control data is established for each of said musical control functions, wherein musical control is effected based on said musical control functions, said electronic musical instrument comprising:

a) operational means provided with designation switches and a write switch, whereby when operation of said designation switches is detected, a designation indication signal is generated, and when operation of said write switch is detected, a write indication signal is generated;

b) operational history memory means wherein operational history data is stored indicating the operational history of each of said musical control data;

c) control means wherein when one of said designation indication signals has been generated, based on said operational history data, data corresponding to one musical control function from among said musical control data, is selected, displayed and designated, and wherein when said write indication signal has been generated, the currently displayed and designated musical control data is regarded as having been used resulting in said operational history data being updated using the current musical control data; and wherein said operational history memory means is comprised of a last in—first out buffer.

2. An electronic musical instrument having a plurality of musical control functions for which musical control data is established for each of said musical control functions, wherein musical control is effected based on said musical control functions, said electronic musical instrument comprising:

a) operational means provided with designation switches and a write switch, whereby when operation of said designation switches is detected, a designation indication signal is generated, and when operation of said write switch is detected, a write indication signal is generated;

b) operational history memory means wherein operational history data is stored indicating the operational history of each of said musical control data;

c) control means wherein when one of said designation indication signals has been generated, based on said operational history data, data corresponding to one musical control function from among said musical control data, is selected, displayed and designated, and wherein when said write indication signal has been generated, the currently displayed and designated musical control data is regarded as having been used resulting in said operational history data being updated using the current musical control data;

d) memory means wherein the last designated musical control data is stored;

wherein said operational history memory means stores frequency of use data for each of said musical control data serving as said operational history data, and wherein said control means operates such that when one of said designation indication signals has been generated, based on a ranking of said frequency of use data, musical control data is selected, displayed, and designated, and when said write indication signal has been generated, the currently displayed and designated musical control data is regarded as having been used resulting in said operational history data being updated using the current musical control data;

wherein said operational means includes a designation indication switch number one and a designation indication switch number two serving as said designation switches, and wherein said control means operates such that when said designation indication switch number one has been operated, based on a ranking in said operational history data, the musical control data ranking immediately below the currently displayed and designated musical control data is selected, displayed, and designated, and when said designation indication switch number two has been operated, based on a ranking in said operational history data, the musical control data ranking immediately above the currently displayed and designated musical control data is selected, displayed, and designated, and when said designation indication switch number two has been operated and the currently displayed and designated musical control data is the highest ranking musical control data, the lowest ranking musical control data is selected, displayed, and designated; and wherein said control means operates such that, when one of said designation switches is operated, after a predetermined time interval, the last designated musical control data stored in said memory means is selected, displayed, and designated, and when during said predetermined time interval after said designation switch has been operated, no switch among said designation switches and said write switch has been operated, said musical control data which has been selected, displayed, and designated is regarded as having been used resulting in said operational history data being updated.

3. An electronic musical instrument in accordance with claim 2 above wherein said control means operates such that, when the musical control data selected based on said operational history data is the same as the currently designated musical control data, other musical control data is selected based on said operational history data.

4. An electronic musical instrument in accordance with claim 2 above wherein each musical control function among said plurality of musical control functions is allocated to one of a plurality of musical control groups, and wherein said operational means is further comprised of additional designation switches corresponding to each of said plurality of musical control groups and to said write switch, and wherein said operational history memory means stores for each musical control group among said plurality of musical control groups, operational history data for the musical control data corresponding to each musical control function allocated to said musical control group, and wherein said control means operates such that based on the operational history data corresponding to each musical control group among said plurality of musical control groups, musical control data corresponding to one musical control function is selected, displayed and designated, and when said write indication signal has been generated, the currently displayed and designated musical control data is regarded as having been used resulting in said operational history data being updated.

5. An electronic musical instrument in accordance with claim 4 above wherein each time one of the additional designation switch corresponding one of said plurality of musical control groups is operated, for the operational history data corresponding to the musical control data which is to be selected in the musical control group corresponding to the operated additional designation switch, the rank is updated.

6. An electronic musical instrument in accordance with claims 4 and 5 above wherein for any given musical control group, the musical control data for each musical control function within said musical control groups is compatible for simultaneous use with each musical control function making up one of a plurality of predetermined sets of musical control functions, whereby when one of the musical control functions within a given one of said sets of musical control functions is regarded as having been used, the musical control group for which the musical control functions thereof are regarded as being compatible with the musical control functions making up said set of musical control functions that includes the musical control function that is regarded as having been used is selected, and from within said selected group, one musical control function is selected, displayed and designated based on the ranking in the operational history data corresponding to the musical control functions making up said selected group, and the operational history data corresponding to the musical control data which is regarded as having been used is updated.

7. An electronic musical instrument having a plurality of musical control functions comprising:

designation means for designating a musical control function from among said plurality of musical control functions, whereby said electronic musical instrument controls a musical parameter based on said designated musical control function;

storing means for storing history data representing how frequently each of said plurality of musical control functions has been designated in the past;

updating means for updating said history data when said designation means designates a musical control function; and displaying means for displaying an indicium representing a musical control function from among said plurality of musical control functions based on said updated history data, so that said musical control function corresponding to said displayed indicium can be designated immediately by said designation means.

8. An electronic musical instrument according to claim 2, wherein said designation means comprises a selection member for selecting said indicium displayed by said display means and a setting member for designating said musical control function corresponding to said selected indicium.

9. An electronic musical instrument according to claim 2, wherein said musical control function represents a timbre selection function.

10. An electronic musical instrument according to claim 2, wherein said musical control function represents a rhythm selecting function.

11. An electronic musical instrument having a plurality of musical control functions comprising:

designation means for designating a musical control function from among said plurality of musical control functions, so that said designated musical control functions is utilized in said electronic musical instrument;

storing means for storing history data representing frequency of utilization corresponding to each of said musical control functions;

means for detecting utilization of said musical control function, and updating said history data so that each history data represents the frequency of utilization of each musical control function;

an operator;

means for detecting operation of said operator and outputting a detection signal;

control means for displaying the musical control function which has been utilized most frequently in the past among said plurality of musical control functions based on said updated history data, in response to said detection signal.

12. An electronic musical instrument according to claim 11, wherein said plurality of musical control functions are divided into groups, said operator is a group switch for designating one of said groups, and said control means selects said musical control function in the group designated by said group switch, based on said updated history data, in response to said detection signal.

* * * * *